United States Patent [19]

Uno

[11] Patent Number: 4,869,487

[45] Date of Patent: Sep. 26, 1989

[54] METHOD FOR FEEDING A BLOCKED SHEET UNIT

[76] Inventor: Tadao Uno, 1-84, Matsugaoka 1-chome, Chigasaki-shi, Kanagawa-ken, Japan

[21] Appl. No.: 187,641

[22] Filed: Apr. 28, 1988

[30] Foreign Application Priority Data

Feb. 19, 1988 [JP] Japan ..... 63-36634

[51] Int. Cl.[4] ..... B65H 20/34

[52] U.S. Cl. ..... 271/3.1; 271/218; 271/237; 271/270; 271/268; 414/796.1

[58] Field of Search ..... 271/3, 3.1, 237, 69, 271/306, 307, 308, 312, 313, 189, 190, 191, 216, 217, 218, 270, 268, 200, 201, 204, 310, 220, 221, 279, 280, 264; 414/115, 50, 128

[56] References Cited

U.S. PATENT DOCUMENTS

| | | | |
|---|---|---|---|
| 3,744,649 | 8/1973 | Ward, Jr. | 271/3.1 X |
| 4,297,066 | 10/1981 | Ramcke et al. | 414/115 X |
| 4,313,703 | 2/1982 | Fabrig | 414/115 |
| 4,436,472 | 3/1984 | Kunzmann | 414/115 |
| 4,569,622 | 2/1986 | Buck | 271/218 |
| 4,647,265 | 3/1987 | Uno | 414/115 |
| 4,746,004 | 5/1988 | Hess et al. | 271/270 |

FOREIGN PATENT DOCUMENTS 61-248856 11/1986 Japan .

*Primary Examiner*—Andres Kashnikow
*Assistant Examiner*—Matthew C. Graham
*Attorney, Agent, or Firm*—Wenderoth, Lind & Ponack

[57] ABSTRACT

A method for feeding a blocked sheet unit for continuously taking out a blocked sheet unit from a sheet unit forming section and feeding the blocked sheet unit to a subsequent step, the method for feeding a blocked sheet unit comprises a first step of taking out a generally half length of the blocked sheet unit from the sheet unit forming section. A subsequent stop includes forming a state where a lower surface of a front portion of a blocked sheet unit subsequently fed is partially superposed on an upper surface of a rear portion of a blocked sheet unit precedingly fed. The preceding blocked sheet unit and subsequent blocked sheet unit are clamped at the superposed portion together and simultaneously taking out the generally half length of the blocked sheet units. The final steps include subsequently separating the preceding blocked sheet unit from the subsequent blocked sheet unit one after another and feeding thereof to the subsequent step.

6 Claims, 6 Drawing Sheets

METHOD FOR FEEDING A BLOCKED SHEET UNIT

BACKGROUND OF THE INVENTION

1. Field of the Invention

This invention relates to a method for feeding a blocked sheet unit which can be advantageously put into practice when, for example, printed paper sheets are blocked in a predetermined unit of accumulated paper sheets and feeding such blocked sheet units to a subsequent step one after another, and more particularly to a method for blocking sheets such as paper sheets, synthetic resin sheets and metal sheets and continuously feed such sheets. The method of the present invention is most advantageously carried out especially when such sheets are comparatively long.

2. Description of the Prior Art

Japanese Patent Application Early Laid-Open Publication No. Sho 61-248856 owned by the present applicant teaches a method for feeding a blocked sheet unit, in which sheets of a predetermined length are continuously fed to a sheet unit forming section for accumulation, and a blocked sheet unit composed of a predetermined number of accumulated sheets is taken out and fed to a subsequent step. According to this method, as shown in FIG. 1, the front edges of sheets a which are successively fed are temporarily received by a manipulation claw 100, and in the meantime, a blocked sheet unit A composed of a predetermined number of sheets already accumulated below the position where the front edges of sheets a are temporarily received is taken out in its entirety by a gripper 200, and after the blocked sheet unit A is taken out, the manipulation claw 100 temporarily stops receiving the front edges of sheets a, and then the accumulation of sheets is resumed until they reach the predetermined number, and another blocked sheet unit A taken out by the gripper 200 is fed to a subsequent step by a transferring apparatus such as, for example, a pusher 300. According to this method, it is an essential condition that the entire length of the blocked sheet unit A be completely taken out from the sheet unit forming section by the gripper 200. In the case where the sheet unit is long, the stroke $W_1$ of the gripper 200 always is a distance greater than the entire length of the sheet unit.

However, in the above-described prior art device, since it starts the subsequent step only after the entire length of a blocked sheet unit is taken out from a sheet unit forming section, each take-out stroke $W_1$ takes a long time during the overall operation. As a result, the take-out efficiency (sheet unit feeding speed) is lowered which makes it difficult to follow the sheet accumulation steps with high speed subsequent steps. Therefore, it is the actual situation that the increase of efficiency of the line as a whole (e.g., book processing line, etc.) cannot be achieved. Particularly, in the case where the sheet unit operating time is comparative long, the prior art apparatus has the drawback in that the productivity thereof is considerably lowered.

The present invention has been accomplished in order to eliminate the above-described problems and drawbacks inherent in the prior art apparatus.

SUMMARY OF THE INVENTION

It is therefore a general object of the present invention to provide a method for feeding a blocked sheet unit, in which a blocked sheet unit can be much more efficiently taken out from a sheet unit forming section so that it makes possible high speed operation of the subsequent steps.

A specific object of the present invention is to provide a method for feeding a blocked sheet unit, in which a sheet unit can be taken out with a necessary minimum take-out stroke and highly efficiently supplied to a subsequent step by a simple take-out method as will be described and without modifying the construction of existing elements used for blocking the sheets and taking out the sheet unit.

In order to achieve the above-described objects, there is essentially provided a method for feeding a blocked sheet unit by continuously taking out a blocked sheet unit from a sheet unit forming section and feeding the blocked sheet unit to a subsequent step. The method for feeding a blocked sheet unit comprises the step of taking out a part of the length (e.g. a half length) of the blocked sheet unit from the sheet unit forming section by improving the step for taking out the entire length of the sheet unit as in the prior art. The method further comprises the step of creating a state where the lower surface of a front portion of a subsequently fed blocked sheet unit is partially superposed on the upper surface of a rear portion of a previously fed blocked sheet unit. This superposed state is formed as a result of the take-out of only a part of the length of the blocked sheet unit. The method still further comprises the step of clamping the preceding blocked sheet unit and subsequent blocked sheet unit together at the superposed portion and simultaneously taking out generally a half length of the blocked sheets. The method still further comprises the step of subsequently separating the preceding blocked sheet unit from the subsequent blocked sheet unit and then feeding them one after another to the subsequent step.

According to the present invention, when the first half part of a sheet unit is taken out upon start of the operation, this becomes a preceding blocked sheet unit only half of which is taken out. When the first half parts and second and subsequent sheet units are taken out, the remainder of the length of each preceding blocked sheet unit is taken out at the same time and fed. That is, even while reducing the take-out stroke to a necessary minimum and therefore considerably reducing the take-out time, the entire length of a preceding blocked sheet unit can be taken out and fed to the subsequent step. For example, when a half part take-out is performed in which a half of the blocked sheet unit is taken out, the take-out speed of each blocked sheet unit can be doubled and the successive blocked sheet unit can be fed to the subsequent step at a high speed. Therefore, the feeding efficiency of blocked sheet units per unit time can be considerably improved and the productivity can be greatly increased. In particular, since the entire length of the sheet unit can be taken out with a limited take-out stroke according to the present invention, the productivity can be considerably increased even though the sheet unit is comparatively long.

Moreover, the method of the present invention can be carried out without substantially modifying the construction of existing machinery but merely requires changing the take-out method of taking sheet units out from the sheet unit forming section. Therefore, the problems involved in the prior art can be reasonably solved by simple means according to the present invention.

The above and other objects and attendant advantages of the present invention will be apparent to those skilled in the art from the following description and claims in conjunction with the accompanying drawings which constitute part of this specification.

BRIEF DESCRIPTION OF THE DRAWINGS

FIGS. 4A and 4B are perspective views of a manipulation apparatus, wherein FIG. 4A shows a gripper in the non-clamping state and FIG. 4B shows a gripper in the clamping state;

DETAILED DESCRIPTION OF THE PREFERRED EMBODIMENTS

One preferred embodiment of the present invention will be described in great detail hereunder with reference to FIGS 2–6.

Figure 1:
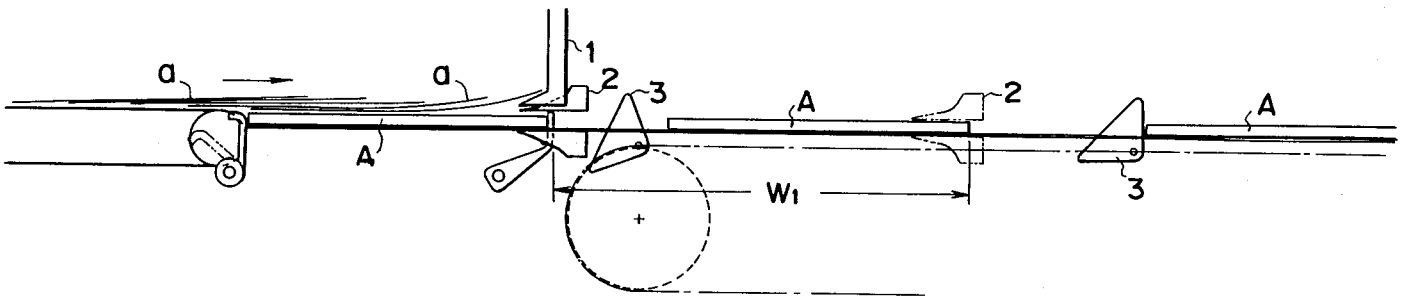
FIG. 1 PRIOR ART
FIG. 1 is a side view schematically showing a conventional apparatus for feeding a blocked sheet unit.
Figure 2:
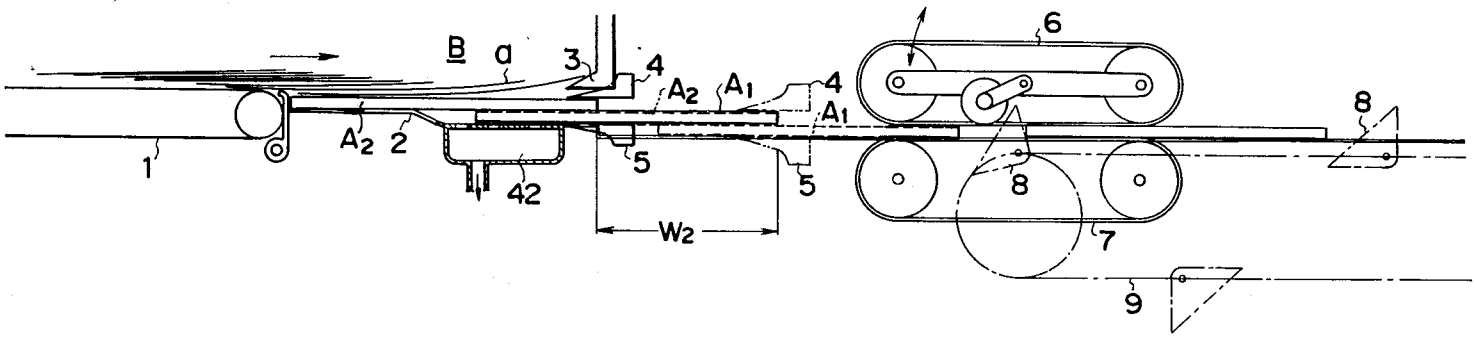
FIG. 2 is a side view schematically showing an apparatus for feeding a blocked sheet unit according to one embodiment of the present invention.
Figure 3A:
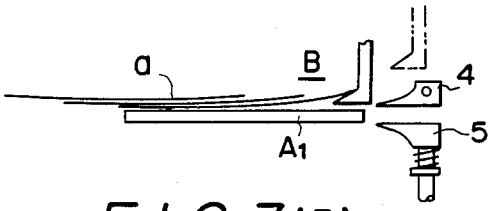
FIGS. 3A, 3B, 3C, and 3D are side views of the apparatus for explaining the operation of the present invention.

As shown in FIGS. 2–5, particularly FIG. 3A, sheets a of a predetermined length are continuously fed by a conveyor 1 from a preceding step, for example a printing step, and accumulated on a table 2 of a sheet unit forming section B until a predetermined number of accumulated sheets is reached to form a preceding blocked sheet unit $A_1$.

When the supply of sheets a has reached the predetermined number of accumulated sheets, a manipulation claw 3 is moved from a standby position shown by a broken line in the figure to an upper position (temporary receiving position) of a front edge of the preceding blocked sheet unit $A_1$ to start temporarily receiving subsequent sheets a so that the preceding blocked sheet unit $A_1$ can be taken out by grippers 4 and 5.

Figure 3B:
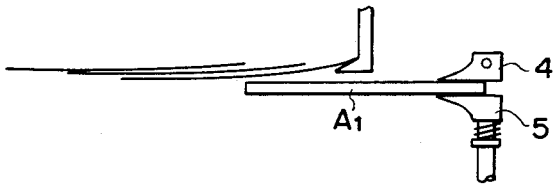

As shown in FIG. 3B, during the receipt of subsequent sheets, the grippers 4 and 5 clamp the front edge of the preceding blocked sheet unit $A_1$ and take it out in a forward direction. As previously described, the grippers 4 and 5 take out only a part of the length (e.g., one half of the length in the transferring direction) of the blocked sheet unit $A_1$. In other words, the grippers 4 and 5 take out generally a half length of the blocked sheet unit $A_1$. $W_2$ denotes the take-out stroke of the grippers 4 and 5.

When the half length of the blocked sheet unit $A_1$ has been taken out, the manipulation claw 3 is moved to the standby position to be ready for the subsequent temporary receipt of the sheets of a next successive sheet unit and the half-lenth take-out.

Then, the sheets which have been temporarily received by the manipulation claw 3 drop down and the lower surfaces of the front portions come to rest on the upper surface of the rear portion of the preceding blocked sheet unit $A_1$ one half of the length of which has been taken out. The sheets a are continuously accumulated until the predetermined number of accumulated sheets is reached to form a subsequent block sheet unit $A_2$.

Figure 3C:
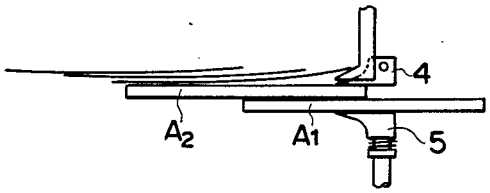

In this way, as shown in FIG. 3C, the lower surface of the front portion of the subsequent blocked sheet unit $A_2$ is superposed on the upper surface of the rear portion of the preceding blocked sheet unit $A_1$, and at this time, the grippers 4 and 5 are moved from the draw-out stroke end position to the manipulation position to grip both the preceding and subsequent blocked sheet units $A_1$ and $A_2$ by clamping the superposed portions and then drawing both blocked sheet units out. In this case, the grippers 4 and 5 take out half the length of the preceding and subsequent blocked sheet units $A_1$ and $A_2$ as previously described. The grippers 4 and 5 are reciprocated through the stroke $W_2$.

Figure 3D:
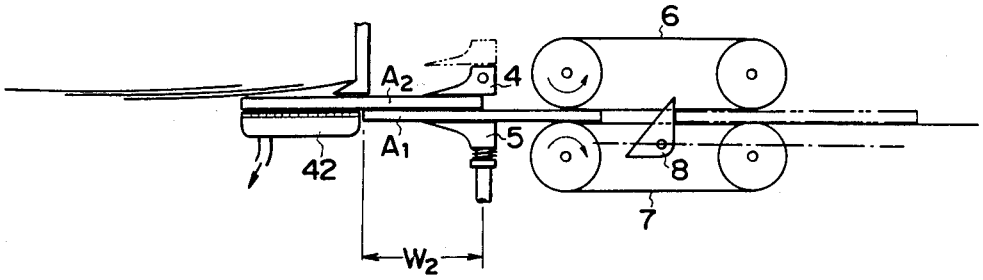

As shown in FIG. 3D, as a result of the take-out of this half length, the preceding blocked sheet unit $A_1$ already partially taken out in FIG. 3D, is completely taken out, whereas the subsequent blocked sheet block $A_2$ is partially taken out. Immediately following this take-out manipulation, the preceding blocked sheet unit $A_1$ is separated from the subsequent blocked sheet unit $A_2$ and supplied to the subsequent step. After the preceding blocked sheet unit $A_1$ is separated, the front portion of the next subsequent blocked sheet unit is accumulated on the rear portion of the subsequent blocked sheet unit $A_2$ to form the afore-mentioned superposed state. In this case, the subsequent blocked sheet unit $A_2$ after separation of the unit $A_1$ becomes the preceding blocked sheet unit, whereas the blocked sheet unit being formed subsequently becomes the subsequent blocked sheet unit.

In order to separate the preceding blocked sheet unit $A_1$ from the subsequent blocked sheet unit $A_2$ with precision, suction means 42 is provided. The suction means 42 has a suction chamber facing the lower surface of the table 2 under the manipulation claw 3, so that the front surface of the table 2 has a suction function. Since the gripper is released when the preceding blocked sheet unit $A_1$ is separated, there is a danger that the separating movement of the preceding blocked sheet unit will carry along sheets of the lower layer portion of the subsequent blocked sheet unit $A_2$ which is overlapped on the rear portion of the preceding blocked sheet unit $A_1$. To be specific, there is a possibility that the subsequent blocked sheet unit $A_2$ will slide forward or collapse and a proper size paper unit cannot be provided. The suction means 42 sucks and holds the lower surface of the rear portion of the subsequent blocked sheet unit $A_2$ which is partially superposed on the rear part of the preceding blocked sheet unit $A_1$ when the preceding blocked sheet unit $A_1$ is separated, so that the sheets of the lower layer portion of the subsequent blocked sheet unit $A_2$ are not dropped along with the preceding sheet unit as it is separated and the subsequent blocked sheet unit $A_2$ does not slide or collapse, and so that the separating treatment is adequate performed.

As means for separating each preceding blocked sheet unit $A_1$ from each subsequent blocked sheet unit $A_2$, a pair of clamp conveyors 6 and 7, as shown in FIG. 3D for example, are provided to convey the preceding blocked sheet units $A_1$ forward by clamping the front end portion of the preceding blocked sheet unit $A_1$ which has been completely taken out by repetition of the half length take-out manipulation of the grippers 4 and 5 from the sheet unit forming section B. While performing the half length take-out manipulation by the trippers 4 and 5 as shown in the parts of FIG. 3, the front end of the preceding blocked sheet unit $A_1$ is introduced between the clamp conveyors 6 and 7, so that the above-described separating manipulation is performed.

As shown in FIGS. 2 and 3D, the separated preceding blocked sheet unit $A_1$ has the edge pushed by a pusher 8 travelling around an endless chain 9 and is thereby supplied to the subsequent step.

It is noted that each blocked sheet unit $A_1$, $A_2$ . . . always has half of its length taken out, which is a distance corresponding to a part of the length in the transferring direction of the sheet unit from the sheet unit forming section B by the grippers 4 and 5 every time a half length of a subsequent sheet unit $A_2$ is taken out, the remainder of the length of each preceding blocked sheet unit $A_1$ is taken out. As a result, even while greatly reducing the stroke $W_2$ (and therefore the time for taking out the blocked sheet unit) by the half length take-out manipulation, the taking out of a preceding blocked sheet unit $A_1$ is completed and the sheet unit $A_1$ supplied to the subsequent step every time the half length take-out manipulation is performed.

Figure 4A:
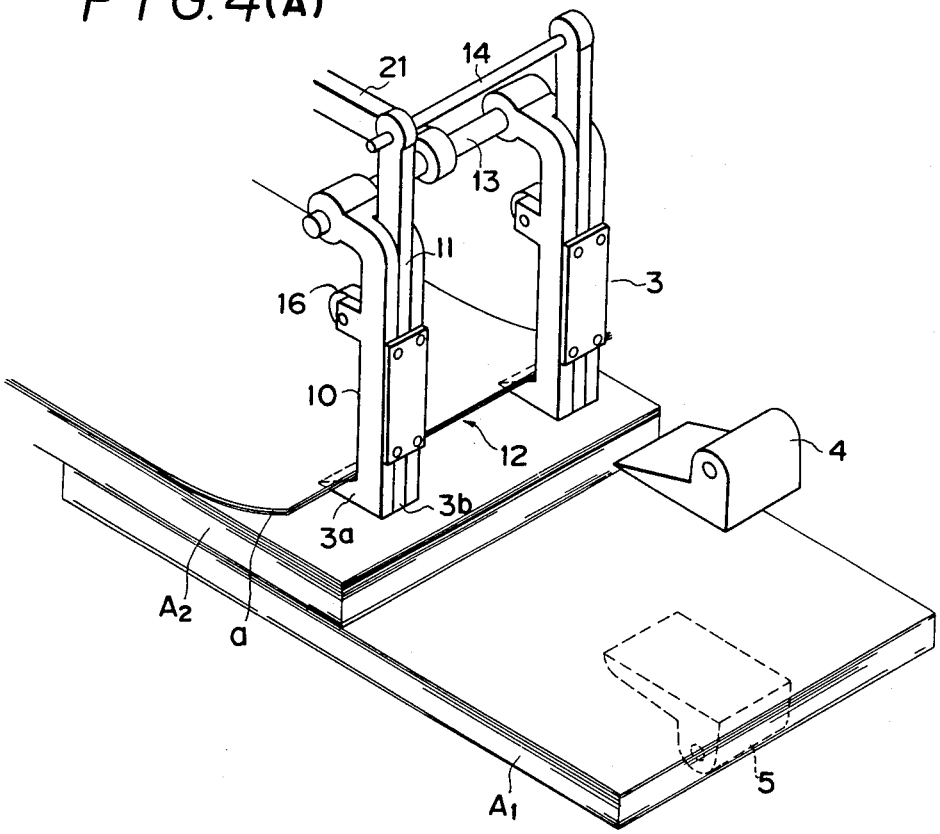
Figure 4B:
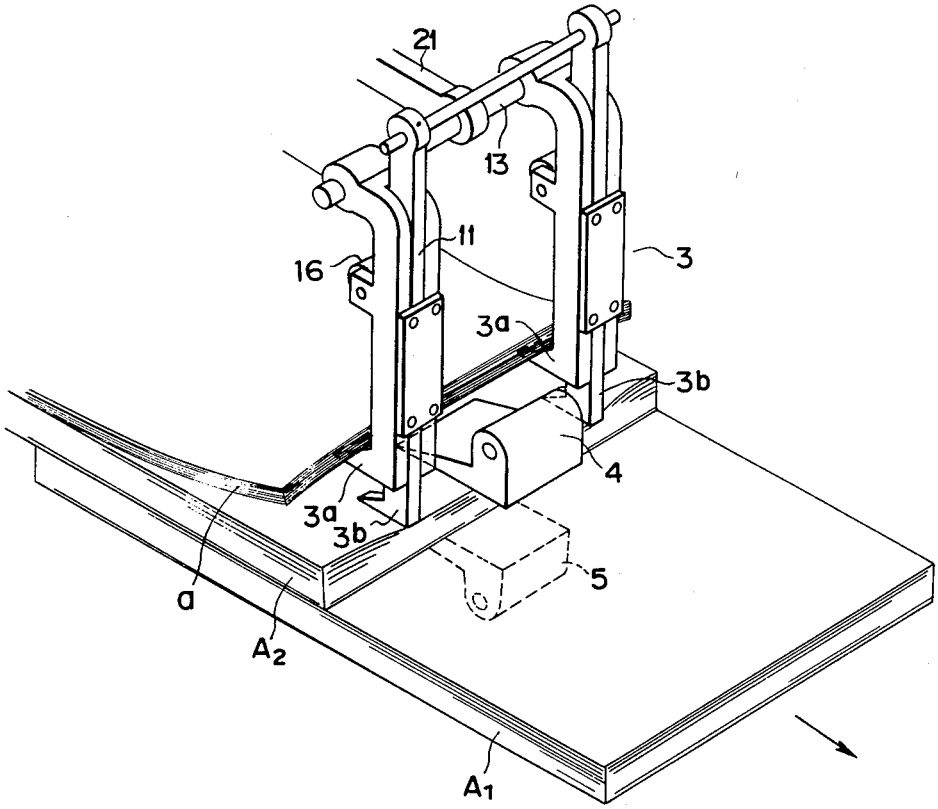

FIGS. 4A and 4B are views for concretely explaining the construction of a blocked sheet unit of the sheet unit forming section B and the half length take-out thereof. More particularly, the figures illustrate one example in which the present invention utilizes a manipulation apparatus, such as the manipulation claw 3, which is provided by Japanese Patent Application Early Laid-open Publication No. Sho 61-248856.

As shown in the figures, the manipulation claw 3 comprises a main claw **3*a* and an auxiliary claw 3*b*. The main claw 3*a* is reciprocally supported by an arm 10 so as to be movable with respect to the front edge of the sheet a, whereas the auxiliary claw 3*b* is supported by a slide arm 9. The slide arm 9 is vertically movably disposed within the arm 10 of the main claw 3*a* and movable with respect to the upper surface of the front edge portion of the subsequent blocked sheet unit $A_2$ with the arm 10 serving as a guide. The auxiliary claw 3*b* is accommodated within the main claw 3*a* during ascent of a slide arm 11 and is projected downward of the main claw 3*a* during the descent thereof. The projected auxiliary claw 3*b* presses the upper surface of the front edge portion of the subsequent blocked sheet unit $A_2$ accumulated on the table 2 of the sheet unit forming section B while the sheets a of the next subsequent blocked sheet unit are temporarily received by the main claw 3*a*. The pressure on the subsequent blocked sheet unit $A_2$ by the auxiliary claw 3*b* and the temporary receipt of the sheets a by the main claw 3*a* form a space 12** between the sheet unit $A_2$ and the sheets a for inserting the gripper therein.

As shown in the figures, two sets of such a main claw **3*a* and auxiliary claw 3*b* are provided; one set on the right and the other set on the left, so that the grippers 4 and 5** may move in and out between each set without interference therewith.

In this way, the grippers 4 and 5 are moved from the draw-out stroke end position to the manipulation position where the grippers 4 and 5 clamp the superposed portion of the preceding blocked sheet unit $A_1$, half of the length of which has been taken out as described and the subsequent blocked sheet unit $A_2$, the auxiliary claw **3*b* releases the pressure on the subsequent blocked sheet unit $A_2$, the preceding blocked sheet unit $A_1$ and the subsequent blocked sheet unit $A_2$ are taken out by a half length respectively, and as a result, the preceding blocked sheet unit $A_1$ which has been completely taken out is transferred to the aforementioned separating step. After the half length is taken out, the set of the main claw 3*a* and auxiliary claw 3*b* is integrally moved to the standby position to release the temporarily received sheets a from the main claw 3*a***. As a result, the sheets a form a new blocked sheet unit which is accumulated again with the front portion thereof superposed on the rear portion of the blocked sheet unit $A_2$, a half of the length of which has been taken out.

The main claw **3*a* has the upper end portion of the arm 10 thereof suspended from a shaft 13 and swung between the temporary receiving position and the standby position with the shaft 13 as a fulcrum, whereas the auxiliary claw 3*b* has the upper end portion of the slide arm 11 thereof suspended from a shaft 14 for applying ascending and descending forces to the shaft 14, so that the arm 11 is independently moved up and down within the arm 10, thereby to move up and down the auxiliary claw 3*b* supported by the arm 11 to press the sheet unit and release the pressure thereon. At the same time, the auxiliary claw 3*b* is swung between the temporary receiving position and the standby position in accordance with the swinging movement of the main claw 3*a*. In this case, the main claw 3*a* may be vertically movably disposed, so that the front edges of the sheets a are lifted upward by slightly raising the main claw 3*a* temporarily receiving the sheets a to open a wider space 12** for inserting the gripper.

The afore-mentioned movement of the main claw **3*a* and the auxiliary claw 3*b*** can be produced by any suitable means such as cam means, a fluid pressure cylinder, or electromagnetic means.

Figure 5:
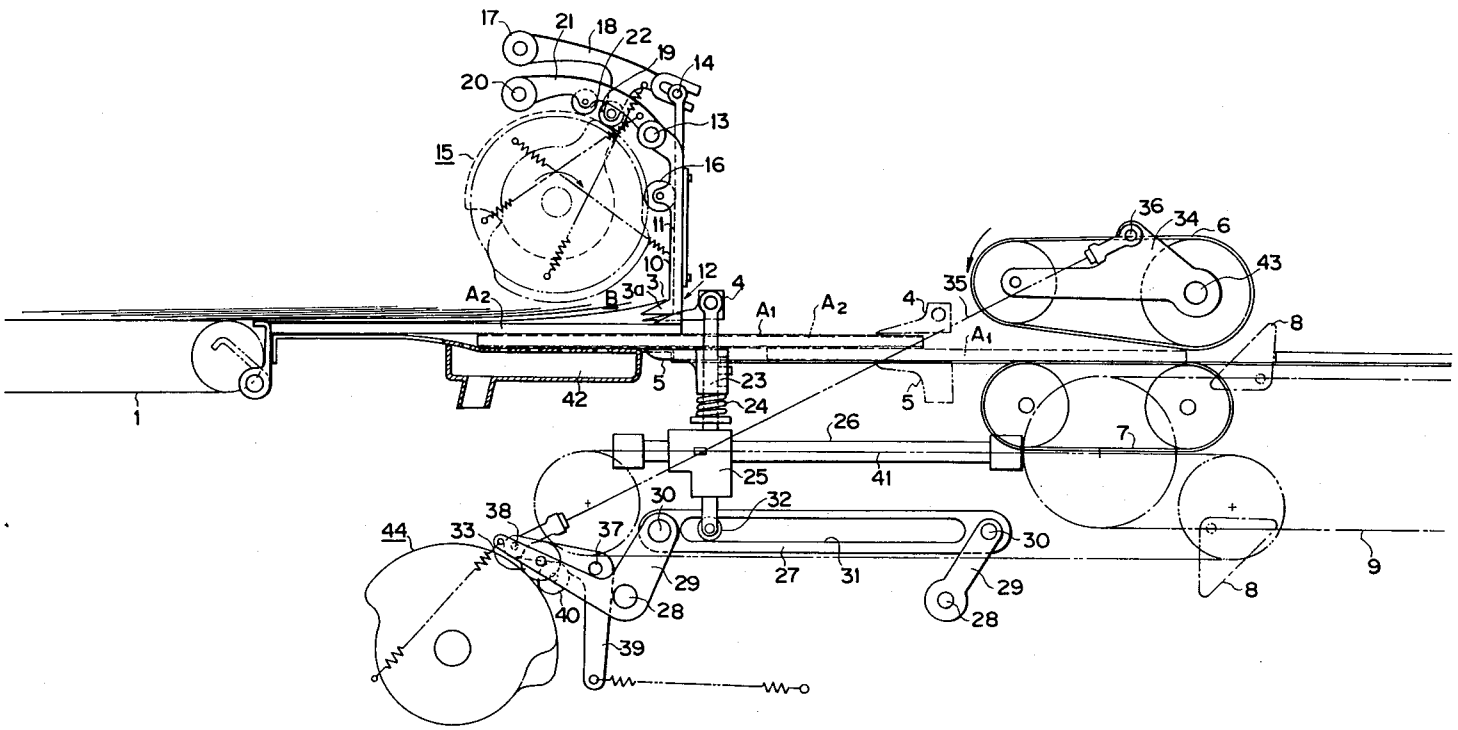
FIG. 5 is a side view of the whole apparatus which is used for carrying out the present invention.

As shown in FIG. 5, a cam mechanism 15 is provided, and by rolling a cam follower 16 mounted on the arm 10 of the other main claw **3*a* along one cam surface on the periphery of the cam mechanism, the main claw 3*a* and the auxiliary claw 3*b* are caused to swing forward and rearward to the temporary receiving position and the standby position. Also, a lever 18 is swingable about a shaft 17 is linked to the shaft 14 of the auxiliary claw 3*b*, and by rolling a cam follower 19 along another cam surface on the cam mechanism, the lever 18 is caused to swing up and down to slide the arm 11 connected thereto up and down, thereby to move the auxiliary claw 3*b*** up and down between the sheet unit pressing position and the pressure releasing position.

Further, a lever 21 swingable up and down on a shaft 20 as a fulcrum and carrying the shaft 13 as a fulcrum for forward and rearward movement of the main claw **3*a*, and the lever 21 is provided with a follower 22 rolling along the cam surface of a still further peripheral cam surface, thereby to move the lever 21 and the arm 10 up and down and to move the main claw 3*a*** up and down so that the sheets can be lifted upward.

The gripper means comprises an upper gripper 4 and a lower gripper 5. As one example of the manipulation mechanism thereof, as shown in FIG. 5, the lower gripper 5 is vertically movably inserted into a support post 23 of the upper gripper 4. The lower gripper 5 is resiliently held by a coil spring 24 wound around the support post 23 so as to always apply an upward force to the lower gripper 5. Because of the foregoing arrangement, the lower gripper 5 is moved down against the coil spring 24 and raised according to the force of the coil spring. On the other hand, the gripper 4 is moved up and down for clamping and releasing the clamping. A cam lever 27 is laterally disposed parallel to a carry-out path of the blocked sheet unit. Both ends of the cam lever 27 are pivotally supported on respective crank arms 29 swingable around shafts 28 as a fulcrum by shafts 30. Because of the foregoing arrangement, the cam lever 27 is parallelly shifted by the swinging movement of the crank arms 29. The cam lever 27 is provided with an orbit 31 comprising an elongated groove extending in a direction parallel to the carry-out path. A roller 32 mounted on the lower end of the support post 23 of the gripper 4 is snugly fitted in the orbit 31 so that the rotor 32 can be moved along the orbit 31.

When the cam lever 27 is parallelly shifted, the support post 23 is caused to slide up and down by the roller 32, and the gripper 4 is caused to move up and down to clamp the superposed portion of the blocked sheet units $A_1$ and $A_2$ and release the clamping. During the clamping manipulation, the gripper 5 is pushed down against the spring 24 to increase the manipulation force due to the spring restoring force.

On the other hand, the spring 24 resiliently moves the lower gripper 5, so that the grippers 4 and 5 always clamp the blocked sheet units $A_1$ and $A_2$ at the superposed portion with precision.

The swinging movement of the crank 29 and the parallel shifting movement of the cam lever 27 can be obtained by providing, for example, a cam mechanism 44 to cause the follower 33 mounted on the end portion of the crank arm 29 to roll along the cam surface of the cam mechanism 44.

After the grippers 4 and 5 clamp the superposed portion, the sheet units are taken out by a half length as described before. As means for taking out the half length of the sheet units, as shown in FIG. 5, the support post 23 of the upper gripper 4 is inserted into a slider 25 so as to be longitudinally slidable therein and the slider 25 is slidable on a rail 26 which is disposed parallel to the carry-out path of the blocked sheet units so as to be slidable along the rail 26. The slider 25 is connected to an endless belt type reciprocating mechanism 41 extending parallel to the rail 26. Due to the foregoing arrangement, forward movement of the reciprocating mechanism causes the slider 25, the support post 23 and the grippers 4 and 5 to be laterally moved to the draw-out stroke end portion, whereas the rearward movement causes the grippers 4 and 5 to be laterally moved to the manipulation position. As described previously, the advancing and retracting stroke of the grippers 4 and 5 is the stroke $W_2$ for taking out a part of the length of the blocked sheet unit.

In this way, after clamping the preceding blocked sheet unit $A_1$ and the subsequent blocked sheet unit $A_2$ at the superposed portion, the grippers 4 and 5 are moved through the take-out stroke $W_2$ shown in FIG. 2 to take out a half length of the sheet units $A_1$ and $A_2$ and then allow the preceding blocked sheet unit $A_1$, the entire length of which has been taken out by the half length take-out manipulation, to be acted on by the separating means for separating it from the subsequent blocked sheet unit $A_2$ so as to supply it to the subsequent step. At this time, the subsequent blocked sheet unit $A_2$ is drawn and held by the suction means 42.

The separating means comprises, for example, clamp conveyors 6 and 7 disposed along the carry-out path of the sheet units in vertically parallel relation as described previously. The separating means is operated such that the introducing end of the upper clamp conveyor is opened when the preceding blocked sheet unit $A_1$ is introduced and closed when the preceding blocked sheet unit $A_1$ has been introduced. As one example for operating the separating means, as shown in FIG. 5, one end of an operating rod 35 is pivotally attached by a shaft 36 to a connecting frame 34 for connecting the wheels of the conveyor 6, whereas the other end is pivotally attached by a shaft 38 to one end of a lever 39 swingable around a shaft 37 as a fulcrum, so that a follower 40 mounted on the lever 39 is rolled along a cam surface of the cam mechanism 44 to pivot the connecting frame 34 up and down through the operating rod 35 with one end of a shaft 43 as a fulcrum, thereby to open the introducing end of the upper clamp conveyor 6. When the clamp conveyors 6 and 7 are opened, the front end of the preceding blocked sheet unit $A_1$ which has been taken out by the grippers 4 and 5 is introduced therein. After the front end of the preceding blocked sheet unit $A_1$ has been introduced, the clamp conveyors 6 and 7 clamp the sheet unit $A_1$ and separate it from the subsequent blocked sheet unit $A_2$.

After the separation, as previously described, the pusher 8 arrives and pushes the separated blocked sheet unit $A_1$ at the rear edge thereof to the subsequent step.

Figure 6:
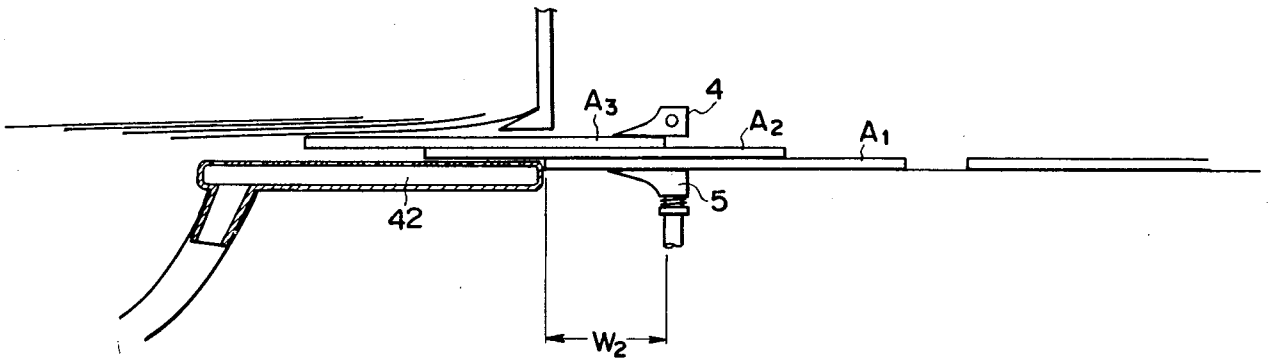
FIG. 6 is a side view of an important part of a modified embodiment thereof.

FIG. 6 illustrates another embodiment of the present invention, in which three blocked sheet units $A_1$, $A_2$, and $A_3$ are superposed in three stages, and the superposed portion is clamped by the grippers 4 and 5 to carry out the take-out manipulation.

In this method, at the start of the operation, one-third of the length of the preceding blocked sheet unit $A_1$ is taken out with the take-out stroke $W_2$. Then the preceding blocked sheet unit $A_1$ and the subsequent blocked sheet unit $A_2$ are taken out by a stroke equal to one-third of the length thereof. Then the preceding blocked sheet unit $A_1$ and the subsequent blocked sheet units $A_2$ and $A_3$ are taken out by a stroke equal to one-third of the length thereof. Thereafter, by repeating the one-third length take-out manipulation of the superposed portions of the three blocked sheet units in the same manner as described, the preceding blocked sheet unit $A_1$ is subjected to the separating step for separating it from the others.

As described in the foregoing, according to the present invention, when a blocked sheet unit is to be taken out from a sheet unit forming section, the afore-mentioned partial length take-out manipulation is carried out to form a state where the preceding blocked sheet unit and the subsequent blocked sheet unit have portions which are superposed, then the superposed portions of the preceding blocked sheet unit and the subsequent blocked sheet unit are clamped and taken out by moving the clamped units a distance corresponding to the partial length thereof, and then the preceding blocked sheet unit is separated from the others. Accordingly, while making it possible to greatly reduce the take-out stroke, and hence the take-out time, the entire length of the preceding blocked sheet unit can be taken out with precision every time the take-out manipulation is carried out and then the taken-out preceding sheet unit can be supplied to the subsequent step. By this method, the efficiency of the supply of the blocked sheets units per unit time can be greatly increased so that it can effectively cope with the high speed operation of the steps to follow. Therefore, the method of the present invention can greatly contribute to increase the capacity of a book making line, for example.

According to the present invention, since the entire length of the blocked sheet unit can be taken out with a necessary minimum stroke of the grippers, it can be hoped that the take-out efficiency can be greatly improved, especially when the sheet unit is comparatively long, and thus the productivity is greatly improved.

Further, it can cope with the take-out of a long sheet unit as well as a short sheet unit with precision merely by varying the take-out stroke thereof.

As previously described, according to the present invention, the supplying efficiency of the sheet unit can be easily improved simply by an idea regarding a simple take-out method for reducing the take-out stroke without changing the capacity of the blocked sheet unit forming section, grippers, etc. Therefore, the problems can be reasonably solved by a simple means.

Although the present invention has been described in its preferred form with a certain degree of particularity, it is understood that the present disclosure of the preferred form has been made only by way of example and that numerous changes in the details of construction and arrangement of parts may be resorted to without departing from the spirit and the scope of the present invention as hereinafter claimed.

What is claimed is:

1. A method for feeding blocked sheet units for continuously taking out blocked sheet units successively formed in a sheet unit forming means and feeding the taken out blocked sheet units to a subsequent step, said method comprising the steps of:

moving a blocked sheet unit constituted by a stack of sheets out of a sheet unit forming means in a direction parallel to the plane of the sheets in the sheet unit and through a distance which is at most a fraction of the length of a sheet unit, while leaving the remaining portion of the length of the sheet unit in the sheet unit forming means;

placing a portion of the length of a blocked sheet unit subsequently formed in the sheet unit forming means, which portion is toward the direction in which the preceedingly taken out blocked sheet unit has been taken out, in superposed relation with the surface of the remaining portion of the length of the preceedingly taken out sheet unit;

clamping said preceedingly taken out sheet unit and said subsequently formed sheet unit together at the position of the superposed portions and moving the partially taken out sheet unit and the subsequently formed sheet unit out of the sheet unit forming means a distance which is at most a fraction of the length of the subsequently formed sheet unit;

repeating the foregoing steps of placing the portion of the length of the subsequently formed sheet unit, clamping the superposed sheet units and moving the clamped superposed sheet units; and when the first blocked sheet unit in the superposed sheet units has been sufficiently in the taking out direction to be completely moved out of the sheet unit forming means, removing it from the superposed sheet units and feeding it to a subsequent step.

2. The method as claimed in claim 1 further comprising the step of, at the time a sheet unit which has been completely moved out of the sheet unit forming means is removed from the superposed sheet units, holding the remainder of the superposed sheet units against movement in the feeding direction of the completely moved out sheet.

3. The method as claimed in claim 2 in which said holding step comprises holding only the next sheet unit to the removed sheet unit in the superposed sheet units.

4. The method as claimed in claim 3 in which said holding step comprises applying a suction to the sheet in the next sheet unit which lies against the removed sheet unit.

5. The method as claimed in claim 1 in which the fraction of the length of the taken out sheet unit is one-half.

6. The method as claimed in claim 1 in which the fraction of the length of the taken out sheet unit is one-third.

* * * * *